US008006349B2

(12) United States Patent
Gill

(10) Patent No.: US 8,006,349 B2
(45) Date of Patent: Aug. 30, 2011

(54) LIGHTWEIGHT GRIP AND METHOD OF MAKING SAME

(75) Inventor: David Keith Gill, Pinehurst, NC (US)

(73) Assignee: Eaton Corporation, Cleveland, OH (US)

( * ) Notice: Subject to any disclaimer, the term of this patent is extended or adjusted under 35 U.S.C. 154(b) by 415 days.

(21) Appl. No.: 12/240,315

(22) Filed: Sep. 29, 2008

(65) Prior Publication Data

US 2010/0077568 A1 Apr. 1, 2010

(51) Int. Cl.
*B25G 1/10* (2006.01)

(52) U.S. Cl. ..... 16/421; 29/428; 29/527.1

(58) Field of Classification Search ..... 16/421, 16/430, 431, 110.1, DIG. 12, DIG. 19; 29/428, 29/458, 505, 527.1; 264/238; 473/300; 81/489; 74/551.9

See application file for complete search history.

(56) References Cited

U.S. PATENT DOCUMENTS

| | | | | |
|---|---|---|---|---|
| 4,261,567 | A * | 4/1981 | Uffindell | 473/298 |
| 4,338,270 | A * | 7/1982 | Uffindell | 264/46.4 |
| 4,719,063 | A * | 1/1988 | White | 264/45.2 |
| 5,529,731 | A * | 6/1996 | Bendick et al. | 264/45.5 |
| 6,656,057 | B2 | 12/2003 | Manual et al. | |
| 2009/0124408 | A1 | 5/2009 | Schroder | |
| 2010/0260987 | A1 * | 10/2010 | Huang | 428/212 |

* cited by examiner

*Primary Examiner* — William L. Miller
(74) *Attorney, Agent, or Firm* — Fay Sharpe LLP

(57) ABSTRACT

A light flexible hand grip and method of making with an inner tubular core of flexible rubber with apertures formed therein and an outer tubular cover disposed over the core with a lighter weight annular flexible foam spacer between the core and outer cover. The spacer may be formed by injecting curable material through the apertures. The apertures may be formed by inserting a mandrel in the core, punching the holes and removing the mandrel.

17 Claims, 3 Drawing Sheets

LIGHTWEIGHT GRIP AND METHOD OF MAKING SAME

BACKGROUND

The present disclosure relates to flexible hand grips and particularly, grips of the type employed on a handle or shaft such as may be found on shovels or sporting implements such as tennis racquets and golf clubs for example. Such hand grips are typically molded of pliable or flexible material such as rubber or elastomer and assembled onto the handle or portion of the implement to be grasped manually. Hand grips for such implements have the need to be frictionally retained on the handle portion of the implement and yet need to provide a soft pliable and flexible gripping surface for the user's hand, particularly where the implement is to be moved in an arcuate or swinging motion which would create exertion by the user, as is the case with golf clubs, tennis racquets and tools such as hammers. This has necessitated forming the thickness of the hand grip to an amount sufficient to provide a soft resilient or pliable surface for the user's hand not only for providing adequate grip retention but to prevent discomfort which would cause blisters upon repeated usage. However, where the material thickness has been provided sufficient to yield a compliant or pliable soft flexible surface for the user's hand, this has resulted in the need for a substantial amount of material to be provided in the grip and has yielded a grip that added weight to the implement, increased the amount of material required and a resultant increase in manufacturing costs.

Thus, it has been desired to provide a flexible pliable hand grip for use on an implement which is sufficiently soft to enable the user to grip and retain a hold on the implement during forceful movement and yet provide such a grip that requires a minimum use of material and one that is relatively light in weight.

BRIEF DESCRIPTION

The present disclosure describes a flexible compliant hand grip for assembly onto the handle of an implement such as, for example a hammer, shovel, golf club or tennis racquet and which has an inner tubular core formed of flexible material for receiving the implement handle with an outer tubular member formed of similar flexible compliant material disposed over the inner core with an annular space provided there between which space is filled with a spacer formed of flexible material of substantially lower or reduced bulk density relative to the core and outer member. The inner core is provided with a plurality of spaced apertures through which is injected curable material for forming a filler or spacer in the annular space between the core and the outer tubular member for maintaining the outer tubular member in its position over the core. In the present practice, it has been found satisfactory to form the spacer of injectable curable foam material and to form the core and outer tubular member of flexible elastomeric material.

DETAILED DESCRIPTION

Figure 1:
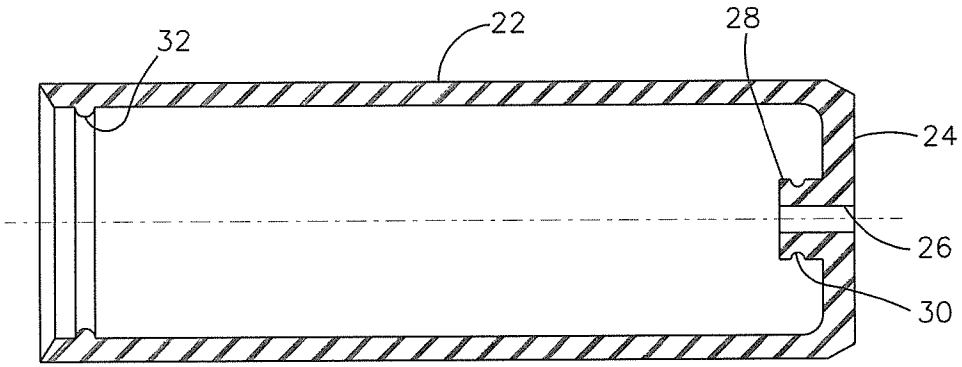
FIG. 1 is a cross-sectional view of an exemplary embodiment of the outer tubular member.
Figure 2:
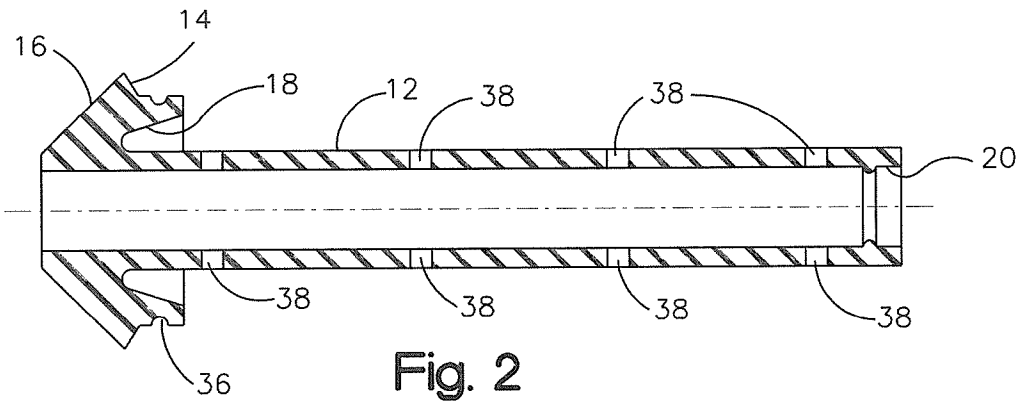
FIG. 2 is a sectional view of an exemplary embodiment of the core member.
Figure 4:
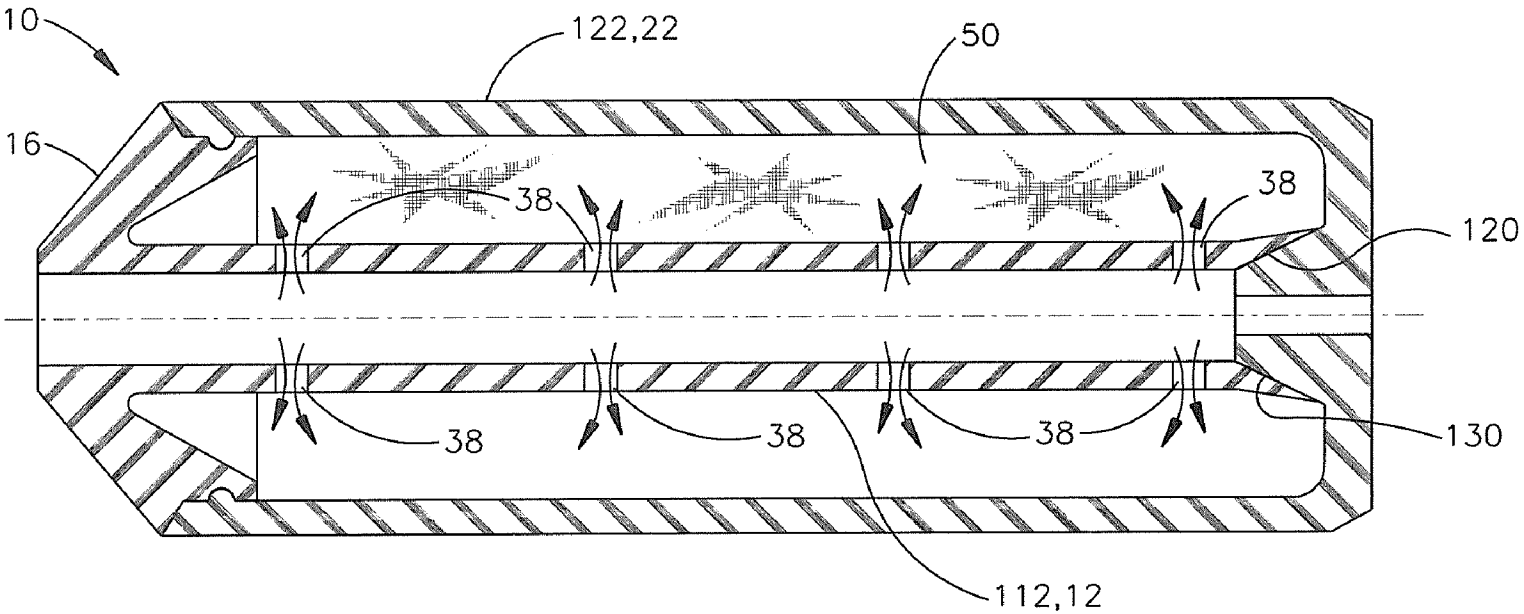
FIG. 4 is a cross-sectional view of an exemplary embodiment of the assembled hand grip.

Referring to FIGS. 1, 2 and 4, a hand grip is indicated generally at 10 and includes a core member 12 having a generally tubular configuration with an outwardly extending flange portion 14 formed on one end thereof with the outer face 16 optionally tapered and, if desired, the flange 14 may include an annular undercut 18 to provide radial resiliency and facilitate manufacture of the grip 10. The core member 12 may include an annular rib 20 on the inner periphery thereof in proximity of the end remote from the flange 14.

Referring to FIG. 1, the outer tubular member 22 is shown as having a closed end 24 provided with a vent hole 26 extending through an inwardly extending projection 28 which may have an annular or circumferential groove 30 formed therein to be engaged by the rib 20 in the core member upon assembly. The outer tubular member 22 may also be provided with an inwardly extending annular rib 32 adjacent the end opposite the closed end 24 which rib 32 is operative to engage an annular groove 36 formed in the outer periphery of the flange 14 of core 12 as shown in the assembled condition in FIG. 4.

Referring to FIG. 2, the core member has a plurality of spaced apertures 38 formed through the wall thereof in a manner as will hereinafter be described in further detail.

Figure 5:
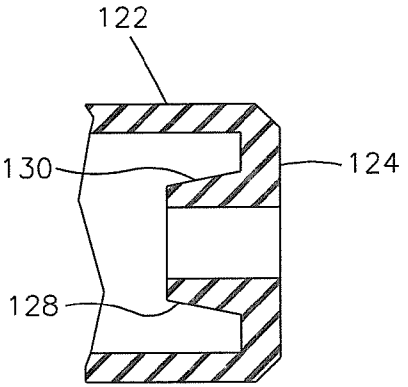
FIG. 5 is a portion of a cross-sectional view similar to FIG. 1 showing an alternate embodiment of the outer tubular member; and, FIG. 6 is a portion of a sectional view similar to FIG. 2 showing an alternate embodiment of the core member.
Figure 6:
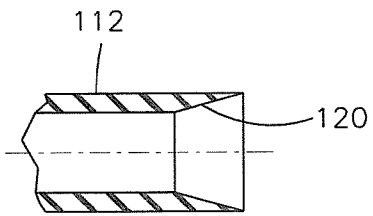

Referring to FIGS. 5 and 6, alternate exemplary embodiments of the ends of the core 12 and outer tubular member 22 are shown wherein the tubular member 122 has the end face 124 thereof provided with an inwardly extending projection 128 which has an annular taper 130 provided thereon. The corresponding embodiment 112 of the core member has the end thereof provided with a tapered surface 120 on the inner periphery thereof which engages the tapered surface 130 on the outer tubular member as shown in FIG. 4.

Figure 3:
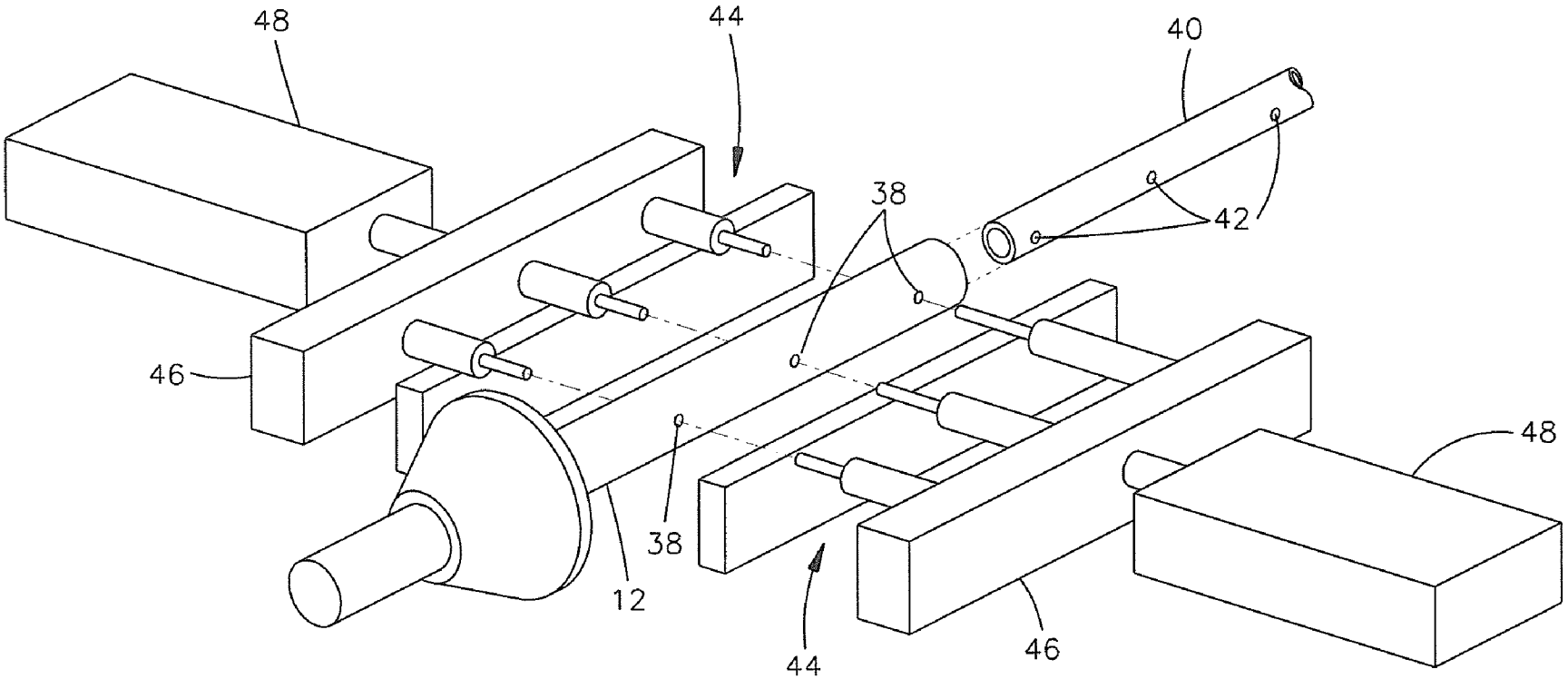
FIG. 3 is an exploded perspective view of the tooling arrangement for punching the apertures in the core member.

Referring to FIG. 3, the core member 12 is shown positioned to have a mandrel 40 with relief holes or apertures 42 formed therein which are sized and located to correspond with the apertures 38 provided on the core 12 with the mandrel inserted into the core member 12 and positioned such that the holes 42 align with the respective apertures 38 in the core member.

A plurality of punches indicated generally at 44 are positioned adjacent the core member 12 and guided by guide blocks 46. The punches 44 are then urged into contact by the drivers 48 which may comprise any convenient mechanical, hydraulic, electrical or pneumatic device such that the punches form the apertures 38 in the core member with the material removed, or plugs, passing to the interior of the mandrel 40 through apertures 42. The material removed by formation of the apertures 38 may then be removed from the mandrel 40 by any suitable expedient, for example, blowing through with compressed air. Upon completion of the punching operation, the mandrel 40 is then removed from the core member 12.

It will be understood that the punching operation the apparatus illustrated in FIG. 3 is performed on the core member 12 prior to assembly with the outer tubular member.

Referring to FIG. 4, the annular space between the outer tubular member 22, 122 and the core 12, 112 is filled with suitable lightweight material or material having a bulk density substantially less than that of the outer tubular member or core as denoted by reference numeral 50. In the present practice, it has been found satisfactory to insert curable material through the apertures 38 in the core member and it has been found particularly satisfactory to inject curable foam material through the apertures 38 to form the spacer 50 in the annular space between the core and outer tubular member. Thus, the lightweight curable material, once cured, provides a resilient support for the relatively thin wall of the outer tubular member, thereby providing adequate cushioning and "feel" to the hand grip when grasped by the user's hand.

In the present practice it has been found suitable to employ ethylene-propylene-diene-monomer (EPDM) material and particularly EPDM foam material for the spacer 50. In the present practice, it has been found satisfactory to form the spacer 50 of curable material having a specific gravity in the range of about 0.1 to 0.7 and having a durometer in the range of about 20-50 on the Shore 'A' scale. However, it will be understood that other suitable injectable curable lightweight materials with adequate flexibility for supporting and flexibly cushioning the outer tubular member may also be employed.

In the present practice, it has been found satisfactory to form the core member 12, 112 and the outer tubular member 22, 122 of flexible elastomeric or rubber material. In particular, it has been found satisfactory to form the core member of material having a specific gravity in the range of about 0.8 to 1.5, of material having a durometer in the range of about 35 to 75 on the Shore 'A' scale and a material having the combination of both. In the present practice, it has also been found satisfactory to form the outer tubular member of flexible material having a specific gravity in the range of about 0.8-1.5, of material having a durometer in the range of about 35 to 75 on the Shore 'A' scale and of material having both properties. However, it will be understood that other materials may be employed as desired for providing adequate gripping by the user and the desired flexibility and "feel" when gripped sufficiently to retain control of an implement upon which the grip is affixed during rapid or forceful movement thereof.

It will be understood that although the hand grip illustrated herein is shown having the inner diameter of the core member relatively small compared to the outer diameter of the tubular member, as would be the case for a golf club hand grip, that the proportions may be changed to accommodate larger size implements to be gripped such as would be the case for a hand grip for an implement such as a hammer, sledge hammer or shovel.

The present disclosure thus describes a flexible relatively soft hand grip for an implement which is light in weight by virtue of a resilient foam facer between the core and outer tubular portion formed in material significantly lighter than the core or outer tubular portion.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of making a flexible hand grip comprising:

(a) forming a tubular core member of flexible material having a plurality of spaced apertures therein;

(b) disposing an outer tubular member of flexible material over the core member and forming an annular space therebetween;

(c) assembling the outer tubular member to the core member and closing the axially opposite ends of the annular space; and, (d) inserting a flexible material of bulk density substantially less than the density of the core and outer member through the apertures into the annular space formed between the core member and outer member.

2. The method defined in claim 1, wherein the step forming a tubular core member includes inserting a supporting mandrel in the core member, punching the apertures and removing the mandrel.

3. The method defined in claim 1, wherein the step of inserting a flexible material includes inserting relatively low density foam material.

4. The method defined in claim 3, wherein the step of inserting relatively low density foam material includes inserting EPDM foam material.

5. The method defined in claim 1, wherein the step of forming a core member of flexible material includes forming a core member of elastomeric material.

6. The method defined in claim 1, wherein the step of forming a core member of flexible material includes forming a core member of flexible material having a durometer in the range of about 35 to 75 on the Shore 'A' scale.

7. The method described in claim 1, wherein the step of forming a tubular core member of flexible material includes forming a tubular core member of flexible material having a specific gravity in the range of about 0.8 to 1.5.

8. The method defined in claim 1, wherein the step of forming a core member of flexible material includes forming a core member of flexible material having a durometer in the range of about 35 to 75 in the Shore 'A' scale and a specific gravity of about 0.8 to 1.5.

9. The method defined in claim 1, wherein the step of disposing an outer tubular member of flexible material includes disposing an outer tubular member of elastomeric material.

10. The method defined in claim 1, wherein the step of disposing an outer tubular member of flexible material includes disposing an outer tubular member of flexible material having a durometer in the range of about 35 to 75 on the Shore 'A' scale.

11. The method defined in claim 1, wherein the step of disposing an outer tubular member of flexible material includes disposing an outer tubular member formed of flexible material having a specific gravity in the range of about 0.8 to 1.5.

12. The method defined in claim 1, wherein the step of disposing an outer tubular member of flexible material includes disposing an outer tubular member formed of flexible material having a durometer in the range of about 35 to 75 on the Shore 'A' scale and a specific gravity in the range of about 0.8 to 1.5.

13. The method defined in claim 1, wherein the step of forming a core member includes forming a core member having an integrally formed outwardly extending flange at an end thereof.

14. The method defined in claim 1, wherein the step of disposing an outer tubular member includes disposing an outer tubular member having an end thereof substantially closed.

15. The method defined in claim 1, wherein the step of closing the axially opposite ends of the annular space includes integrally forming a substantially closed end on the outer member and integrally forming an outwardly extending flange on an end of the core member.

16. The method defined in claim 1, wherein the step of inserting a flexible material includes inserting ethylene-propylene-diene-monomer material.

17. The method defined in claim 1, wherein the step of inserting a flexible material includes inserting a flexible material having a specific gravity in the range of about 0.1-0.9.

* * * * *